United States Patent [19]

Weisse

[11] 4,270,264

[45] Jun. 2, 1981

[54] METHOD FOR ESTABLISHING AN ELECTRICAL CONTACT BETWEEN A NORMALLY CONDUCTING CONTACT ELEMENT AND AT LEAST ONE SUPERCONDUCTOR

[75] Inventor: Hans-Jörg Weisse, Erlangen, Fed. Rep. of Germany

[73] Assignee: Siemens Aktiengesellschaft, Berlin & Munich, Fed. Rep. of Germany

[21] Appl. No.: 76,662

[22] Filed: Sep. 18, 1979

[30] Foreign Application Priority Data

Sep. 18, 1978 [DE] Fed. Rep. of Germany ..... 2840526

[51] Int. Cl.[3] ..... H01V 11/00

[52] U.S. Cl. ..... 29/599; 148/11.5 F; 148/11.5 Q

[58] Field of Search ..... 29/599; 148/133, 11.5 Q, 148/11.5 F, 11.5 R

[56] References Cited

U.S. PATENT DOCUMENTS

| | | | |
|---|---|---|---|
| 1,648,690 | 11/1927 | Jacoby | 148/11.5 F |
| 3,296,684 | 1/1967 | Allen et al. | 29/599 |
| 3,829,963 | 8/1974 | McDougall et al. | 29/599 |

*Primary Examiner*—Charlie T. Moon
*Assistant Examiner*—V. K. Rising
*Attorney, Agent, or Firm*—Kenyon & Kenyon

[57] ABSTRACT

A method for establishing an electrical contact between a normally conducting contact body and the end section of a superconductor annealed in situ, prior to the anneal in which the corresponding end section of the intermediate conductor product is placed on a form of a heat-resistant material which during the anneal does not react with the elements of the intermediate conductor product; and after the anneal, replacing the form with a contact body of corresponding shape. With the method, diffusion reactions between the elements of the intermediate conductor product and the contact body during the in situ anneal are advantageously prevented.

12 Claims, 5 Drawing Figures

METHOD FOR ESTABLISHING AN ELECTRICAL CONTACT BETWEEN A NORMALLY CONDUCTING CONTACT ELEMENT AND AT LEAST ONE SUPERCONDUCTOR

BACKGROUND OF THE INVENTION

This invention relates to superconductors in general and more particularly to a method for establishing an electrical contact with a magnet winding in which a contact element consisting of normally conducting material is connected in an electrically conducting manner with the end section of at least one superconductor of an intermetallic compound which is formed by annealing an intermediate conductor product in-situ.

Conductive intermetallic compounds of the type $A_3B$ with an A15 crystal structure such as for instance, $Nb_3Sn$ or $V_3Ga$, have good super conduction properties and are distinguished by high critical values. Conductors with these materials are, therefore, suitable, especially for superconducting magnet coils, to generate strong magnetic fields. Besides the superconductive binary compounds mentioned, ternary compounds such as niobium aluminum germanium ($Nb_3Al_{0.8}Ge_{0.2}$), are of special interest for conductors of such magnets.

However, these intermetallic compounds are, in general, very brittle, so that their manufacture in a form, for instance, for magnet coils presents difficulties. Therefore, special methods have been developed, by which such conductors with an A15 crystal structure can be made in the form of long wires or ribbons. In these methods, which, in particular, permit the manufacture of so-called multicore conductors, a first component of the intermetallic compound to be prepared which is a ductile element in wire form is generally surrounded by a jacket which consists of a ductile carrier metal having an alloy containing the other elements of the compound. For instance, a niobium or vanadium wire is surrounded by a jacket of a copper-tin bronze or a copper-gallium bronze. A multiplicity of such wires can also be embedded in a matrix of the corresponding alloy. The structure of these two components so obtained is then subjected to a cross section reducing process. One, therefore, obtains a long, wire-shaped structure such as is required for coils, without the occurence of reactions which would embrittle the conductor. After the cross section is reduced, the intermediate conductor product of a superconductor, consisting of one or more wire cores and the surrounding matrix material, is then subjected to an annealing treatment in such a manner that the desired superconductive compound with an A15 crystal structure is formed by a reaction of the core material with the further element of the compound contained in the surrounding matrix. The element contained in the matrix then diffuses into the core material consisting of the other element of the compound (see British Pat. No. 1.280.583).

Superconducting magnet coils made of such superconductors are generally manufactured by two different methods. In the first method, which is also called "react first, then wind" method, the intermediate conductor product of the superconductor to be manufactured is wound on a temporary coil form and is subjected then to the required annealing treatment to form the desired superconductive compound. Subsequently, the superconductor so produced is unwound again from the temporary coil form and can be processed further. In this connection, especially when winding magnet coils, the danger generally exists that the brittle intermetallic compounds of the conductors will be damaged due to excessive deformation and their super-conduction properties will be impaired accordingly.

These dangers do not exist in the second method for manufacturing the superconductive compound from the intermediate conductor product. In this method, which is also called the "wind and react" technique, the coil form of the magnet to be provided with the winding is first wound with the not yet reacted intermediate conductor product of the superconductor and, then, the entire magnet, so wound, is subjected to the diffusion anneal. This anneal is also called an "in situ anneal". With this procedure, all difficulties of processing a brittle conductor material are avoided. It is also possible in this manner to fabricate coils with small inside diameters and relatively thick conductors. However, with this method, all material used in the construction of the coil must withstand, for several hours to days, the high temperatures which are required for diffusion annealing, which can, for instance, in the case of niobium-tin, be 700° C.

In such in-situ annealed magnet coils, the preparation of terminal contacts presents difficulties. For, because of the great brittleness of the reacted A15 superconductors, it is practically no longer possible to bend the leads after the in-situ anneal. Therefore, the ends of the intermediate conductor product of these wires can be arranged on specially formed contact elements of normal conducting material only prior to the in-situ anneal (Proc. of 6th Int. Conf. on Magn. Techn. (MT-6), Bratislava, CSSR, Aug. 29–Sept. 2, 1977—page 998). In the subsequent anneal, however, a reactive element of the conductive compound to be manufactured, for instance, the tin can diffuse out of the conductor material of the intermediate conductor product into the copper of the contact element. Thus, a depletion of the one component of the superconductive compound occurs. The results are weaker superconductor zones and thereby, reduced current carrying capacity of the superconductors. Further difficulties can occur at sharp bends. While this generally does not matter in the unreacted intermediate conductor product, such portions can become critical after annealing because of the mechanical stresses which occur there and are difficult to visualize. Such stresses are caused particularly due to materials of different shrinkage qualities located in the contact area.

SUMMARY OF THE INVENTION

It is, therefore, an object of the present invention to provide a method for the establishment of contacts for conductors of such brittle intermetallic superconductive compounds, in which these difficulties do not occur or are the only of secondary importance.

For a method of the kind mentioned at the outset, this problem is solved, according to the present invention, by applying the corresponding end section of the intermediate conductor product, prior to the annealing, on a form of a heat-resistant material which does not react with the intermediate conductor product during the annealing, and replacing the form, after the annealing, with a contact element of corresponding shape.

The advantages achieved with this method are, in particular, that at no point of the end section of the intermediate conductor product can a reduction of the current carrying capacity of the superconductor occur due to the loss of a component of the superconductive compound to be formed, because the intermediate conductor product comes into contact, in the contact area, during the in-situ anneal, only with materials which practically do not enter into reactions with the elements of the intermediate conductor product. In addition, contacts can be manufactured by this method which are compact and have great mechanical strength.

Accordiang to a further embodiment of the method of the present invention, the end section of the intermediate conductor product is advantageously placed in helically arranged grooves of a cylindrical form; after the annealing, the form is screwed out of the contact helix which is formed by the superconducting end section and has solidified in the annealing; and a cylindrical contact element with predetermined outside diameter is pushed into the helix. In this manner deformations of the superconductor during the course of the process can largely be avoided, and the conditions for a good electrical connection between the contact and the conductor end section can be created. The end section of the intermediate conductor product is advantageously held on the form by means of a clamping device. In this manner the intermediate conductor product is prevented from slipping on the form during the in-situ anneal. After the annealing, the form can then be removed relatively easily and the contact element can be inserted into the space surrounded by the conductor helix.

DETAILED DESCRIPTION OF THE INVENTION

With the method according to the present invention, superconductors of the A15 type, which are, in particular, mechanically adequately stable for instance, monolithic superconductors with relatively large cross section or twisted superconductors can be provided with contacts. For manufacturing magnets with such superconductors, for instance, of the brittle intermetallic compound $Nb_3Sn$, one starts out with an intermediate conductor product such as is described, for instance, in British Pat. No. 1.280.583. For forming this intermediate conductor product, a niobium wire is first surrounded with a jacket of copper-tin bronze. A multiplicity of such wires can also be embedded in a matrix of the bronze. This structure is then subjected to a cross section reducing process. If required, individual intermediate anneals can be performed. Thus, one obtains as the intermediate conductor product, a long wire which is sufficiently ductile. This intermediate conductor product in wire form is then placed on the coil form of a magnet coil.

Figure 1:
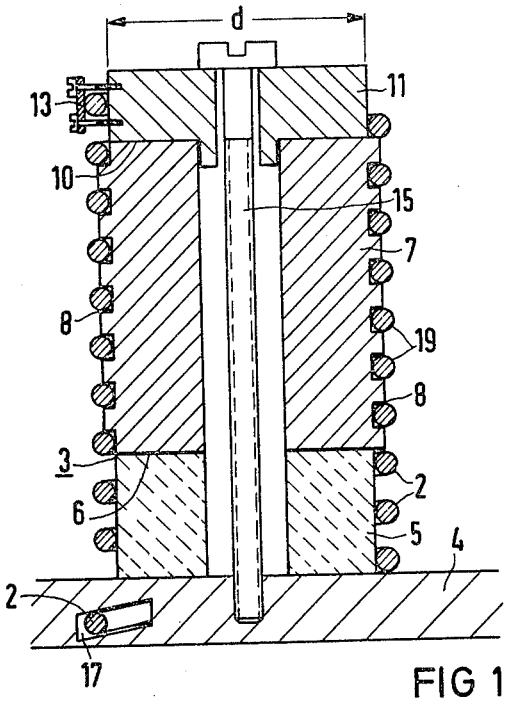
FIGS. 1 to 3 illustrate different process steps of the present invention.

According to the method of the present invention, a temporary arrangement of the intermediate product 2 is provided on a hollow cylindrical winding fixture 3, which is shown schematically in a longitudinal section in FIG. 1. This fixture is fastened on the upper flat side of a coil flange 4 of a winding support, not detailed in the figure, of a magnet coil. The winding fixture 3 contains a hollow cylindricaL base 5 of heat resistant insulating material such as ceramic. Its predetermined outside diameter is designated as d. On the upper flat side 6 of this base a likewise hollow cylindrical form 7 with a comparatively somewhat larger outside diameter is arranged. The outer cylindrical surface of the form is provided with a groove 8 which leads helically upward and is deep enough that the bottom of the groove lies on an imaginary cylindrical surface common with the diameter d of the ceramic base 5.

As materials for the form 7, insulating materials which do not react in an annealing treatment with the elements of the intermediate conductor product and can be machined in ordinary chip removing machines are advantageously used (e.g. the firm of Rosenthal-Stemag, D 8560, Lauf:ERGAN). Corresponding materials may also change into the hard ceramic state only after a special anneal (e.g., the firm of Ore & Metal Comp. Ltd., Johannesburg, S.A., "Wonderstone"; or the firm of Rosenthal-Stemag, Lauf:STENAN). Furthermore, metallic materials with a corresponding nonmetallic temperature resistant coating are also suitable.

The winding fixture 3 contains, in addition, a washer shaped cover part 11 which is arranged on the upper flat side 10 of the form 7. This cover part which likewise has an outside diameter d and consists, for instance, of metal, is provided with at least one fastening device, for instance, a clamping device 13 on its cylindrical surface. Clamping device 13 can be screwed on in order to temporarily secure the intermediate conductor product. The entire device consisting of the cover part 11, form 7, and ceramic base 5 is detachably fastened to the coil flange 4 by means of a central screw 15 engaging the cover part 11.

Through the coil flange 4 a feed-through slot 17 extends at an angle slot 17 is merely indicated. Conductor product 2, which is brought out of the winding space of the coil, can be wound, without bending, helically around the outside surface of the hollow cylindrical ceramic base 5 and can then be placed, without discontinuity, into the helical groove 8 of the form 7. Since the intermediate conductor product 2 is not fixed on the ceramic base 5, a continuous transition from the pitch of the feed through slot 17 in the flange 45 to the pitch of the groove 8 of the form 7 is assured in this part of the fixture 3. The end section of the intermediate conductor product which is designated as 19 and essentially lies in the groove 8 of the form 7 is placed for a distance around the washer shaped cover part 11 and is then secured in its position by means of the clamping device 13.

Thereupon the reaction anneal of the intermediate conductor product pre-formed by the winding is performed, whereby the intermetallic compound is formed; for instance, the niobium of the wire core is reacted by diffusion with the tin from the bronze to form $Nb_3Sn$.

After the reaction anneal, the clamping device 13 is loosened and the form 7 together with the cover part 11 is carefully unscrewed upward. There remains a conductor helix 20, schematically shown in FIG. 2 in a side view, of now superconductive, relatively rigid material, the free end section of which protrudes beyond the ceramic base 5 and is designated as 21.

Figure 2:
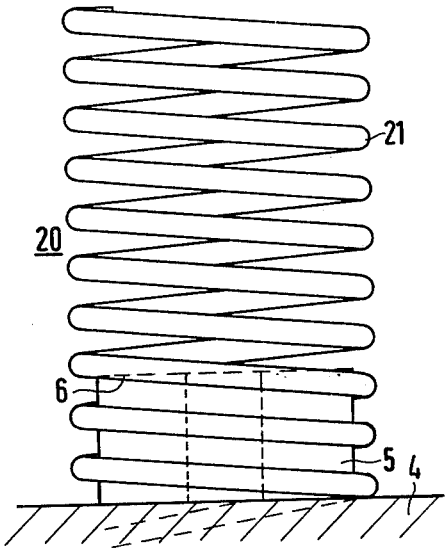
Figure 3:
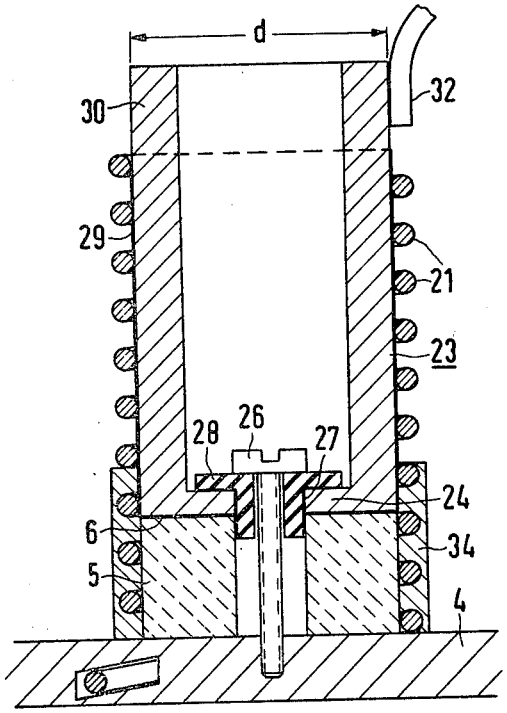

According to the longitudinal section schematically shown in FIG. 3, a hollow cylindrical contact body 23 of an electrically highly conductive material such as copper with an outside diameter corresponding to the inside diameter d of the conductor helix 20 of FIG. 2 formed by the conductive end section 21 is inserted into the conductor helix from above and fastened on the ceramic base 5. For this purpose the bottom part 24 of the contact body, which is disc shaped and rests against the upper flat side 6 of the ceramic base 5, is screwed to the upper side of the coil flange 4 by means of a fastener screw 26. In order to insure that the screw and, therefore, the coil flange are insulated from the contact body 23, its bottom part 24 is provided with a hole 27 and is held by the screw via an insulating washer 28. Advantageously, the contact body 23 can have a tinned outside surface 29, so that the bronze matrix material of the superconducting end section 21 can readily be soldered thereto and thus an electrically highly conducting large area connection between these parts is obtained.

To the head section 30 of the contact body 23, which protrudes upward from the end section 21 beyond the conductor helix, at least one normal conductor 32, merely indicated in the figure, can be connected in an electrically conducting manner. In order to make a large-area connection, for instance by soldering, possible between these parts, the head section 30 may have, for instance, a square cross section.

The conductor parts brought out of the coil flange 4, particularly the parts that rest on the ceramic base 5 are advantageously secured by means of suitable securing means 34, for instance, a filled epoxy resin setting at room temperature or a ceramic cement, in order to prevent conductor movements.

In the embodiment according to FIGS. 1 to 3, it was assumed that a large area electrical contact is to be established between a normal conductor and a superconductor with the method explained so as to allow feeding current in or taking current from a conducting magnet coil. The method according to the present invention is also equally well suited, however, for connecting superconducting parts of a coil annealed in situ to each other. For, individual superconductor sections of such a coil cannot be tied together in a practical manner, either before or after the annealing of the coil, within the winding space of the coil. It is, therefore, necessary to bring them out of the winding space and tie them together outside. In that case the end sections of the two conductors to be connected are brought through the coil flange and are placed side by side or on top of each other into the grooves of the form shown in FIG. 1. The remaining process steps differ from the method explained in conjuction with FIGS. 1 to 3 only by now providing two conductor ends instead of a single one, and by omitting the soldering of a normal conductor to the head portion of the contact body. After the anneal, the two superconducting end sections are soldered together and to the contact body.

Figure 4:
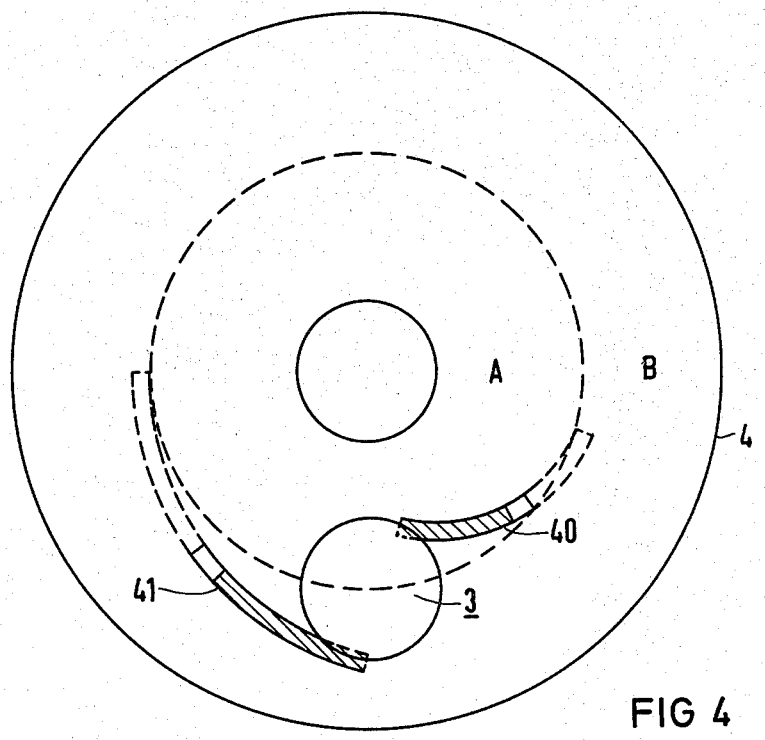
FIGS. 4 and 5 are details of a conductor feed-through through the coil flange of a magnet winding according to the present invention.

So that one or more intermediate conductor products can be placed on the winding fixture 3 according to FIG. 1 without a bend, the feedthrough for the intermediate conductor product through the flange 4 must be shaped accordingly. In FIG. 4 the top view onto such a coil flange is shown schematically. It is assumed here that contact between the conductor ends of two winding sections A and B, of a magnet winding, concentrically enclosing each other is to be made by the method according to the present invention. Therefore, two feedthrough slots 40 and 41 which have a curved shape in order to make possible a continuous transfer with a bend of the individual conductor ends on the outer surface of the winding fixuture 3 are required. These slots can, for instance, be made by milling; guidance and support of the conductor is then possible only in the radial direction, however. Because of the desired curved shape of the slots and the resulting possibility of support and guidance of the conductor on almost all sides, the slots are advantageously spark-eroded. The electrodes required for this method may have tube segments milled off at an angle with a wall thickness corresponding to the width of the slot, and may consist, for instance, of copper or graphite.

Figure 5:
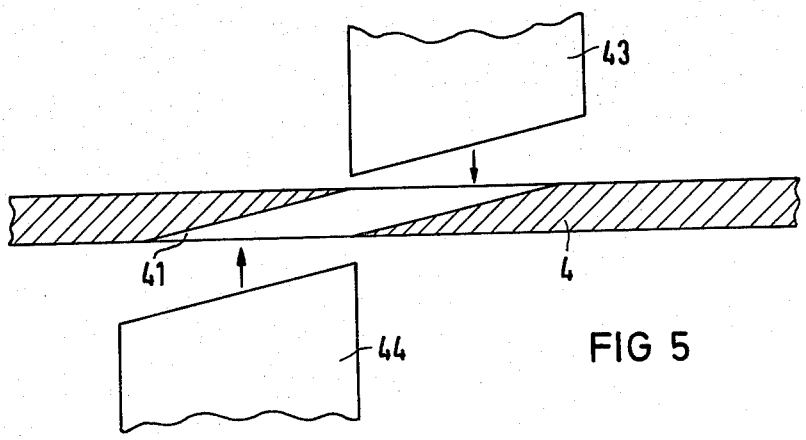

According to the longitudinal cross section schematically shown in FIG. 5, two bevelled electrodes 43 and 44 are required which are driven into a flange from the top side of the flange 4 or the bottom side by spark erosion.

If several feed throughs are to be made in a coil flange, it is advantageous to mount all the electrodes which are to be driven in from the top side of the flange, and all corresponding electrodes to be driven in from the underside of the flange, on respective common support plates. All feed through slots can then be worked in with these two electrode arrangements by spark erosion in only two operations. Reworking the slots such as the rounding of sharp corners becomes largely unnecessary.

In the illustrated embodiment, a conductor or intermediate conductor product of circular cross section was assumed. However, profiled conductors with a rectangular cross section can be joined together equally well with the method according to the present invention; such conductors have sufficient mechanical strength in themselves and are relatively difficult to bend over their narrow sides. Such profiled conductors are also suitable particularly for intermediate contacts since they are easy to solder to each other and to the contact body over a large surface.

It was further assumed in the illustrated embodiment that the superconductor which is to be connected to the contact body in an electrically conducting manner consists of the intermetallic compound $Nb_3Sn$, which is formed by the so-called bronze technique by annealing the conductor in situ. With the method according to the present invention, however, conductors of other superconductive materials, the intermediate conductor products of which are sufficiently ductile for winding on a temporary coil form without danger can be equally well joined together or to normal conductors.

What is claimed is:

1. A method for establishing an electrical contact in a magnet coil, between a contact body consisting of normally conducting material and the end section of at least one superconductor of an intermetallic compound which is formed by in situ appealing of an intermediate conductor product, comprising:

(a) placing the corresponding end section of the intermediate conductor product, prior to the anneal, on a form of heat resistant material which does not react with the elements of the intermediate conductor product during the anneal; and (b) after the annealing, replacing the form with a contact body of corresponding shape.

2. The method according to claim 1, and further comprising placing the end section of the intermediate conductor product in grooves in a cylindrical form and then arranging the superconducting end section formed after annealing on the cylindrical surface of a cylindrical contact body.

3. The method according to claim 2, comprising: placing the end section of the intermediate conductor product in helically arranged grooves of said form; after the annealing, screwing the form out of the conductor helix which is hardened during the anneal and is formed by the superconducting end section; and inserting a contact body of predetermined outside diameter having a smooth cylindrical surface into the conductor helix.

4. The method according to claim 1 and further coamprising attaching the superconducting end section to the contact body by soldering or welding.

5. The method according to claim 1, and further including holding the end section of the intermediate conductor product on the form by means of a clamping device during the anneal.

6. The method according to claim 1 and further including placing the form and the contact body respectively, on a hollow cylindrical support body of corresponding outside diameter.

7. The method according to claim 6, comprising using as said support body, a support body of a heat resistant insulating material which does not react with the elements of the intermediate conductor product during the anneal.

8. The method according to claim 6 and further including securing the parts of the annealed superconductor resting on the support body to said support body.

9. The method according to claim 1 wherein said form is made of an insulating material.

10. The method according to claim 1 wherein said form is made of a material which is hardened by heat treatment.

11. The method according to claim 1, wherein said form and said contact body respectively, are arranged on the outside of a flange of a coil form for the magnet winding.

12. The method according to claim 11, and further including forming a conductor feed-through slot in the flange by means of spark erosion.

* * * * *